US010024334B2

(12) United States Patent
Lei et al.

(10) Patent No.: US 10,024,334 B2
(45) Date of Patent: Jul. 17, 2018

(54) CENTRIFUGAL FAN AND FAN FRAME THEREOF

(71) Applicant: Delta Electronics, Inc., Taoyuan Hsien (TW)

(72) Inventors: Tsung-Yu Lei, Taoyuan Hsien (TW); Ching-Hua Wu, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 535 days.

(21) Appl. No.: 14/096,525

(22) Filed: Dec. 4, 2013

(65) Prior Publication Data

US 2014/0348646 A1 Nov. 27, 2014

(30) Foreign Application Priority Data

May 21, 2013 (CN) ..... 2013 1 019 0156

(51) Int. Cl.
*F04D 29/42* (2006.01)

(52) U.S. Cl.
CPC ..... *F04D 29/4226* (2013.01); *F04D 29/4213* (2013.01)

(58) Field of Classification Search
CPC ..... F04D 29/4213; F04D 29/4226; F04D 29/4206
See application file for complete search history.

(56) References Cited

U.S. PATENT DOCUMENTS 820,398 A * 5/1906 Davidson ..... F04D 29/4226 415/204
820,399 A * 5/1906 Davidson ..... F04D 29/4226 415/204
1,862,523 A * 6/1932 Anderson ..... F04D 29/162 415/58.3
3,824,028 A * 7/1974 Zenkner ..... F04D 29/4213 415/182.1
7,186,080 B2 * 3/2007 Smiley, III ..... F04D 29/4226 415/205
2006/0165525 A1 * 7/2006 Kuo ..... F04D 29/4213 415/206

FOREIGN PATENT DOCUMENTS

DE 2952146 * 12/1979 ..... F04D 29/42
DE 3629132 * 10/1988 ..... F04D 29/40

* cited by examiner

*Primary Examiner* — Woody Lee, Jr.
*Assistant Examiner* — Brian O Peters
(74) *Attorney, Agent, or Firm* — Muncy, Geissler, Olds & Lowe, P.C.

(57) ABSTRACT

A fan frame of a centrifugal fan comprises a housing and an inlet structure. The housing includes an opening. The inlet structure is disposed at the opening and includes a top portion and an edge portion. The top portion is disposed around the opening and includes a plurality of first chamfering angles, at least one of the chamfering angles is different from the others. The edge portion extends from the top portion to the inside of the housing through the opening and includes a plurality of second chamfering angles. A centrifugal fan including the fan frame is also disclosed.

19 Claims, 12 Drawing Sheets

CENTRIFUGAL FAN AND FAN FRAME THEREOF

CROSS REFERENCE TO RELATED APPLICATIONS

This Non-provisional application claims priority under 35 U.S.C. § 119(a) on Patent Application No(s). 201310190156.6 filed in People's Republic of China on May 21, 2013, the entire contents of which are hereby incorporated by reference.

BACKGROUND OF THE INVENTION

Field of Invention

The invention relates to a centrifugal fan and, in particular, to a fan frame.

Related Art

With the higher and higher demand for the heat dissipation of systems, more and more fans with different sizes are developed and utilized. No matter what kind of size or type the fan is, increasing the heat dissipation efficiency is a main trend in the current industry.

FIG. 1A is a schematic diagram of a conventional fan. As shown in FIG. 1A, the fan F' includes a fan assembly 1 and a fan frame 2. The fan frame 2 is disposed corresponding to the fan assembly 1. The fan frame 2 is disposed around the fan assembly 1 and an accommodating space S' is formed therebetween. The fan frame 2 further includes an inlet structure 21 at the inlet of the fan. When the fan assembly 1 is operated, a flow field is formed within the accommodating space S', and the outside air will enter into the flow field through the inlet structure 21. Accordingly, the heat dissipation efficiency of the fan F' can be improved by changing the shape of the inlet structure 21.

FIG. 1B is a schematic sectional diagram of the inlet structure taken along the line A-A in FIG. 1A, and FIG. 1C is a schematic diagram of another view of the inlet structure in FIG. 1A. As shown in FIGS. 1B and 1C, the inlet structure generally includes a hollow portion 221 having an chamfering angle r'. The hollow portion has a circular shape. In the conventional art, the shape of the inlet structure can be adjusted to increase the heat dissipation efficiency of the fan. For an example in FIG. 1D, the inner edge of the hollow portion 221*a* is shaped with a plurality of first chamfering angles R', and thus the hollow portion 221*a* is changed into a non-circular shape. Therefore, the heat dissipation efficiency will be increased. However, the extent of the increment of the heat dissipation efficiency is still limited just by reshaping the inner edge of the hollow portion 221*a* of the inlet structure 21 with a plurality of the first chamfering angles R'.

Therefore, it is an important subject to provide a fan and a fan frame thereof that can enhance the airflow entering into the flow field of the fan and smooth the flow filed much more so that the efficiency and property of the fan can be improved.

SUMMARY OF THE INVENTION

In view of the foregoing subject, an objective of the invention is to provide a centrifugal fan and a fan frame thereof that can enhance the airflow entering into the flow field of the fan and smooth the flow filed much more so that the efficiency and property of the centrifugal fan can be improved.

To achieve the above objective, a fan frame of a centrifugal fan according to the invention comprises a housing and an inlet structure. The housing includes an opening. The inlet structure is disposed at the opening and includes a top portion and an edge portion. The top portion is disposed around the opening and includes a plurality of first chamfering angles, at least one of the chamfering angles is different from the others. The edge portion extends from the top portion to the inside of the housing through the opening and includes a plurality of second chamfering angles.

In one embodiment, at least some of the second chamfering angles are different.

In one embodiment, the length of the edge portion is uneven.

In one embodiment, the edge portion has different lengths at the opposite sides thereof.

In one embodiment, the inlet structure further includes an extension portion, which is extended from the top portion the side away from the edge portion and fixed to the housing.

To achieve the above objective, a fan frame of a centrifugal fan according to the invention comprises a housing and an inlet structure. The housing includes an opening. The inlet structure is disposed at the opening and includes a top portion and an edge portion. The top portion is disposed around the opening and includes a plurality of first chamfering angles, at least one of the chamfering angles is different from the others. The edge portion extends from the top portion to the inside of the housing through the opening and includes at least a second chamfering angle and at least a slope.

To achieve the above objective, a fan frame of a centrifugal fan according to the invention comprises a housing and an inlet structure. The housing includes an opening. The inlet structure is disposed at the opening and includes a top portion and an edge portion. The top portion disposed around the opening and includes a plurality of first chamfering angles, at least one of the chamfering angles is different the others. The edge portion extends from the top portion to the inside of the housing through the opening and includes a plurality of slopes.

In one embodiment, at least some of the slopes are different.

To achieve the above objective, a fan frame of a centrifugal fan according to the invention comprises a housing and an inlet structure. The housing includes an opening. The inlet structure is disposed at the opening and includes a top portion and an edge portion. The top portion is disposed around the opening and includes a plurality of first chamfering angles, at least one of the chamfering angles is different from the others. The edge portion extends from the top portion to the inside of the housing through the opening and includes a plurality of extension surfaces.

In one embodiment, each of the extension surfaces includes a second chamfering angle or a slope.

To achieve the above objective, a centrifugal fan according to the invention includes a fan assembly and any above-mentioned fan frame. The fan assembly includes a motor having a plurality of blades. The fan frame is disposed corresponding to the fan assembly.

In one embodiment, the blades are disposed near the inner edge of the edge portion of the inlet structure.

As mentioned above, the shape of the inlet structure of the centrifugal fan of the invention is changed and thus the form of the inlet of the fan is changed accordingly. Thereby, the air quantity entering to the centrifugal fan is increased and the fan efficiency is enhanced. In detail, the inlet structure is formed with a plurality of first chamfering angles, at least one of the chamfering angles is different from the others, so the hollow portion of the inlet structure is changed into a non-circular shape to adjust the airflow. Besides, the edge portion has a plurality of extension surfaces extending from the top portion to the inside of the housing, and the extension surfaces can be designed according to many factors, such as the whole structure of the housing, airflow path and desired flow field, and thus include at least one second chamfering angle and at least one slope. Thereby, the outside air can be more smoothly guided into the fan. Therefore, the air quantity and fan efficiency are increased and the flow field is smoothed effectively.

Furthermore, the length of the edge portion can be adjusted according to the form of the flow field. For example, when the part of the edge portion probably leaks air, it can be formed with a greater length in order to eliminate the air leakage.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
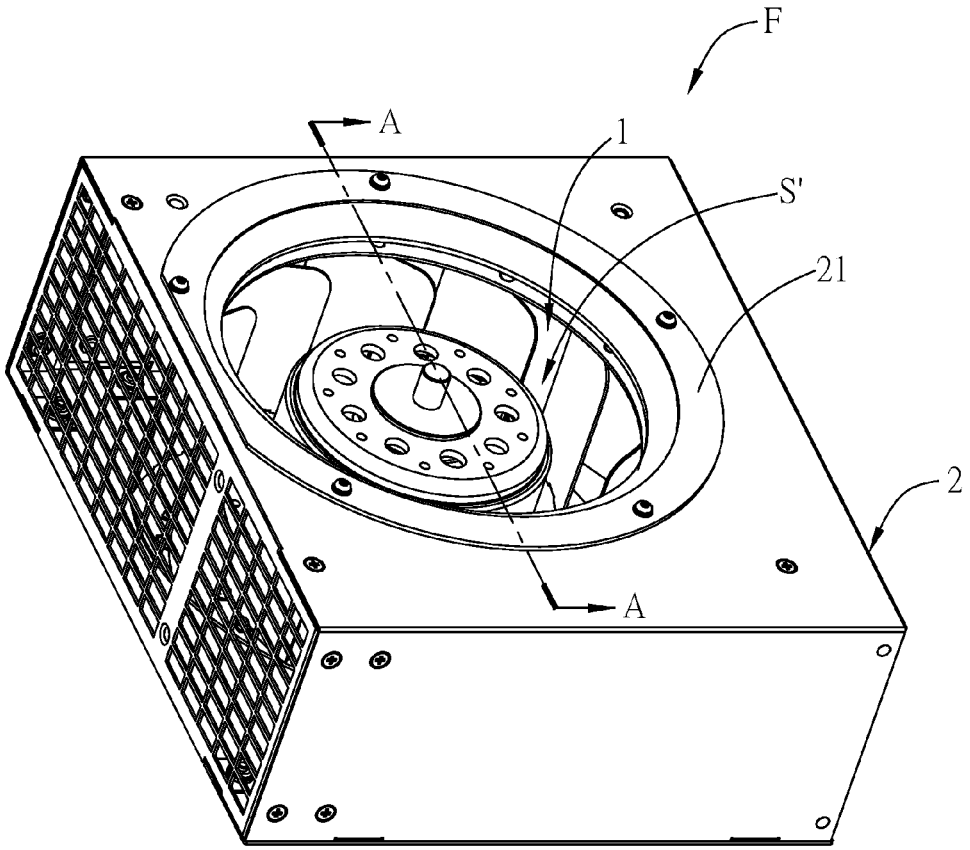
FIG.1A (Prior Art)
FIG. 1A is a schematic diagram of a conventional fan.
Figure 1B:
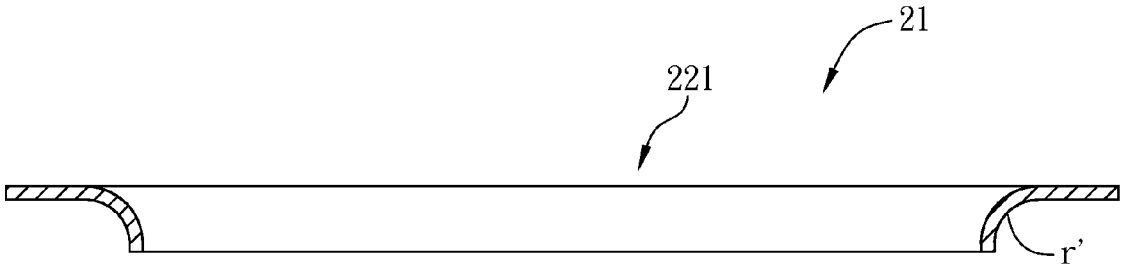
FIG.1B (Prior Art)
FIG. 1B is a schematic sectional diagram of the inlet structure taken along the line A-A in FIG. 1A.
Figure 1C:
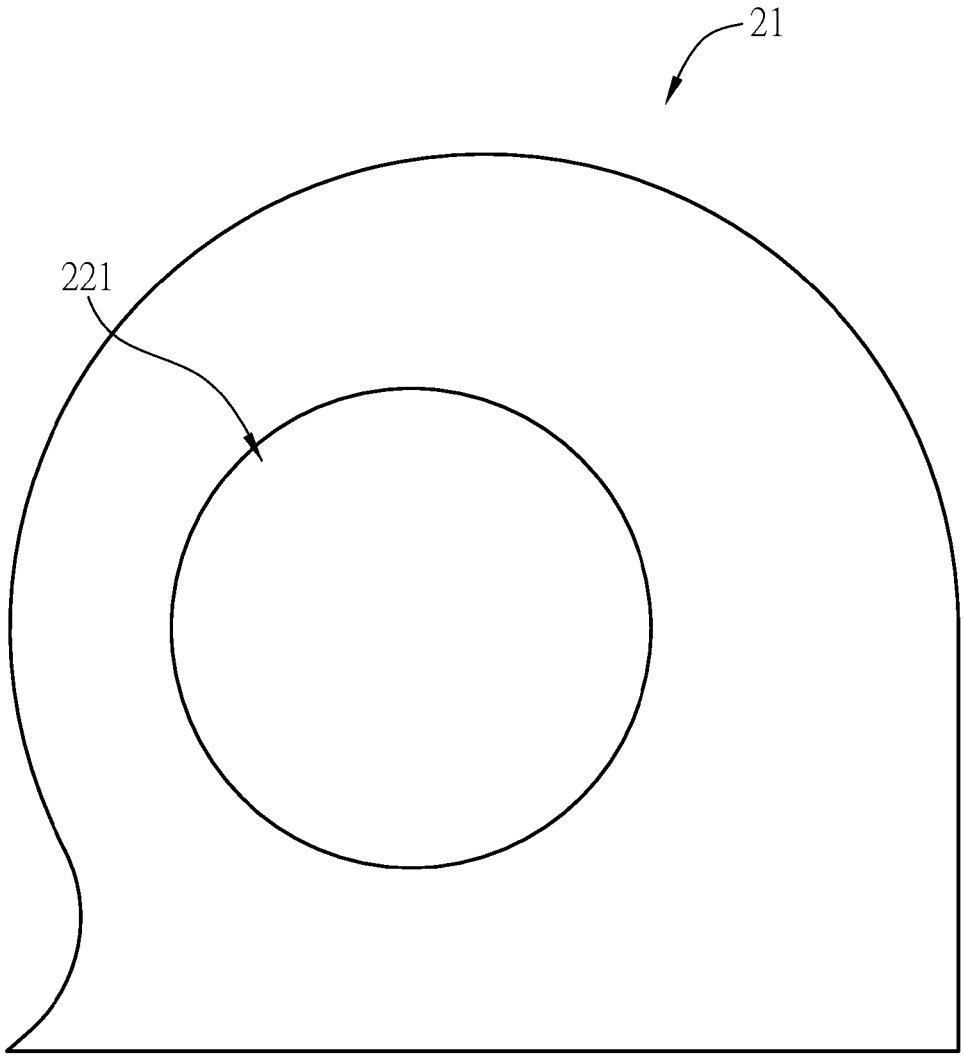
FIG.1C (Prior Art)
FIG. 1C is a schematic diagram of another view of the inlet structure in FIG. 1A.
Figure 1D:
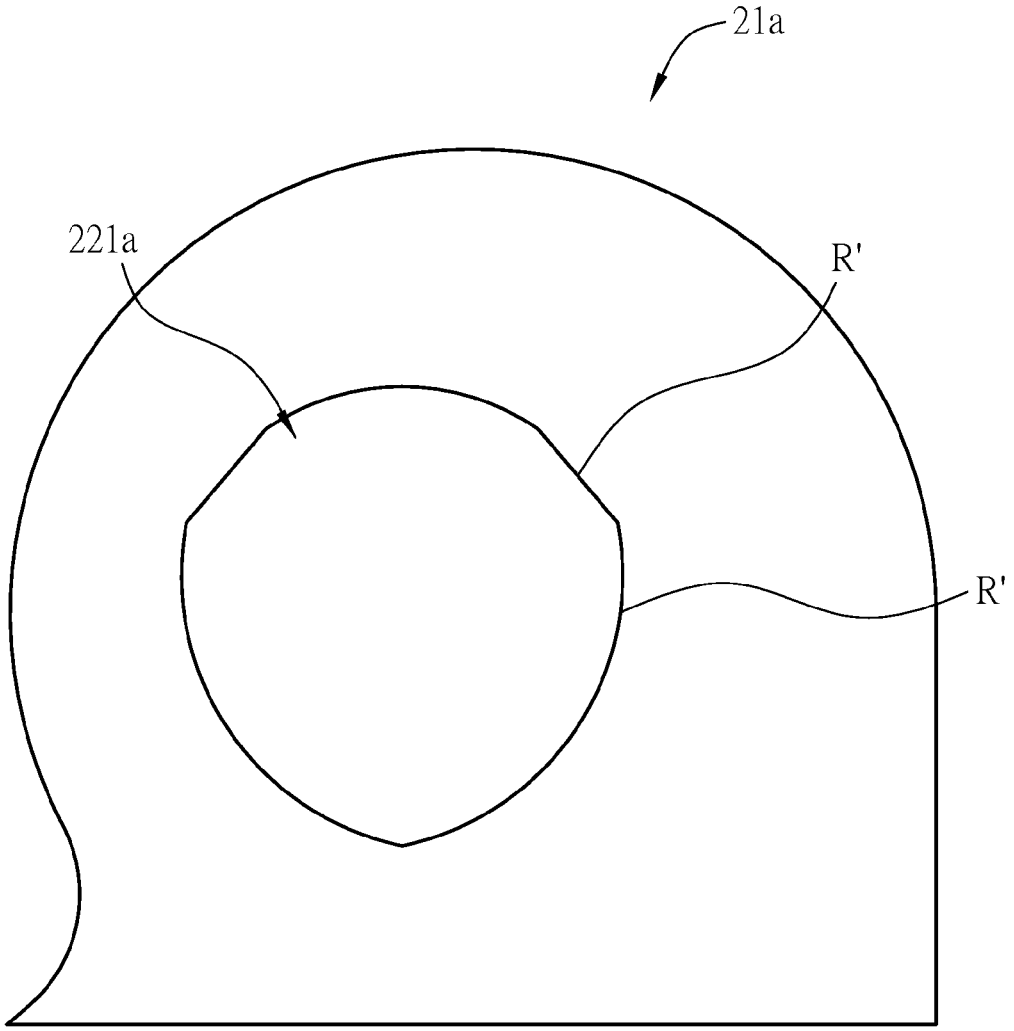
FIG.1D (Prior Art)
FIG. 1D is a schematic diagram of another embodiment of the inlet structure in FIG. 1A.
Figure 2A:
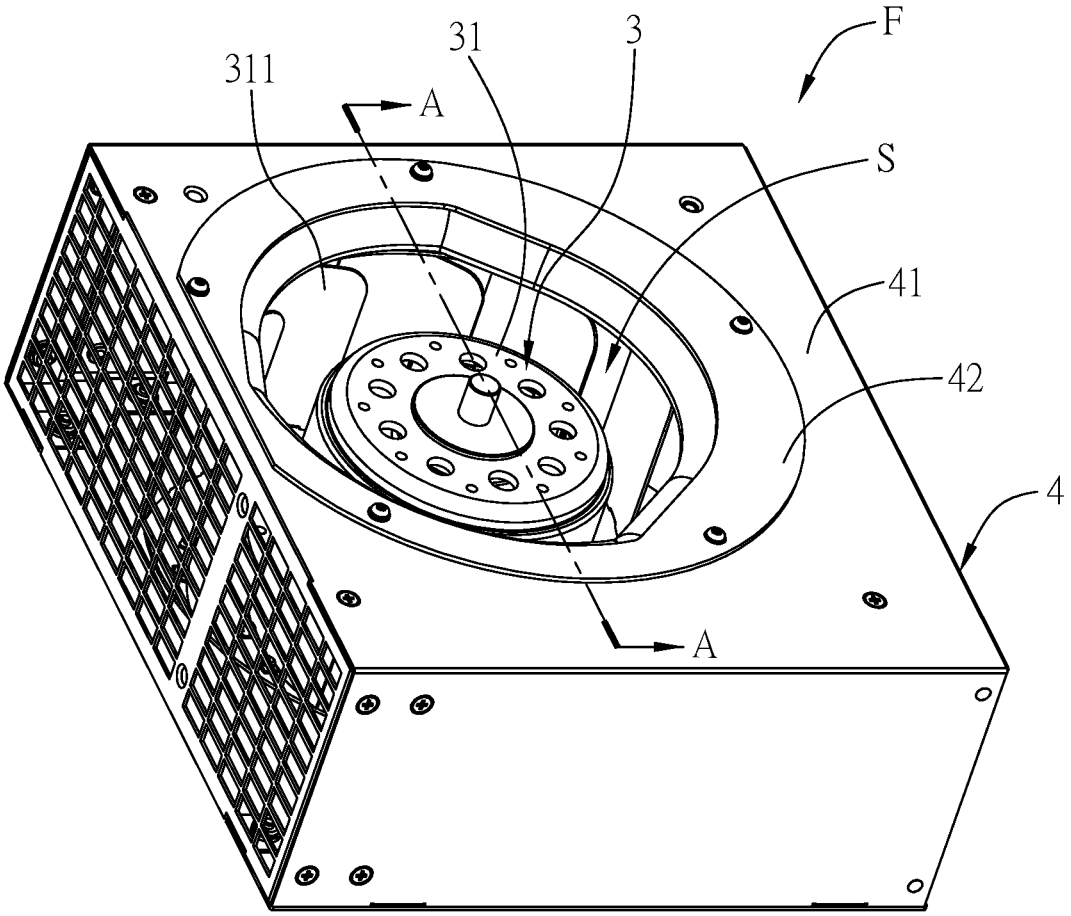
FIG. 2A is a schematic diagram of a centrifugal fan according to the first embodiment of the invention.
Figure 2B:
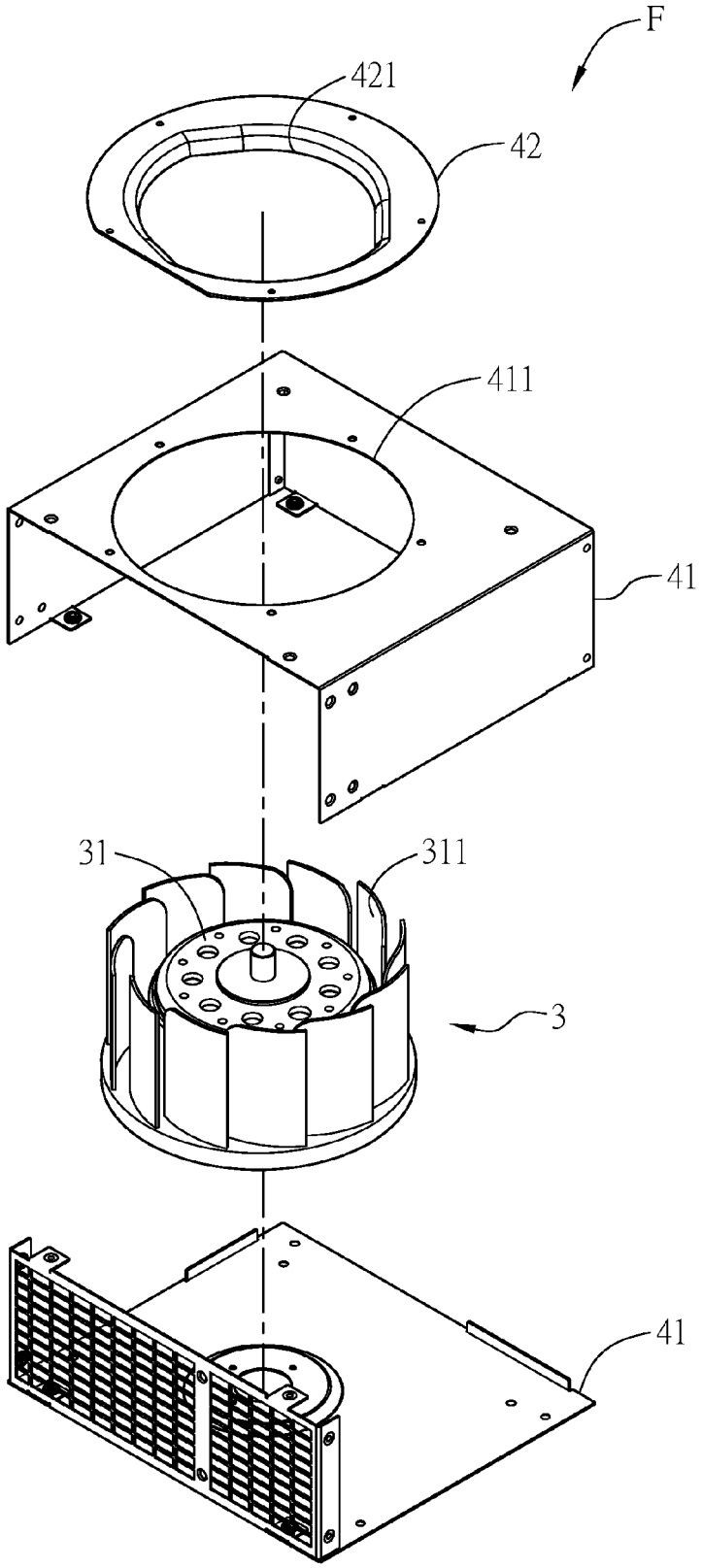
FIG. 2B is a schematic exploded diagram of the centrifugal fan in FIG. 2A.

FIG. 2A is a schematic diagram of a centrifugal fan according to the first embodiment of the invention, and FIG. 2B is a schematic exploded diagram of the fan in FIG. 2A. As shown in FIGS. 2A and 2B, the fan F includes a fan assembly 3 and a fan frame 4. The fan assembly 3 includes a motor 31 having a plurality of blades 311. The fan frame 4 is disposed corresponding to the fan assembly 3 and has an accommodating space S. The fan assembly 3 is disposed in the accommodating space S.

The fan frame 4 includes a housing 41 and an inlet structure 42. The housing 41 has an opening 411. The inlet structure 42 is a ringlike structure and has a hollow portion 421 corresponding to the opening 411. The inlet structure 42 is disposed at the opening 411 and they cooperatively form the inlet of the fan. The motor 31 drives the blades 311 to rotate, and accordingly the outside air will be induced into the accommodating space S of the housing 41 through the inlet (through the hollow portion 421 and opening 411 in other words), forming the flow field within the accommodating space S.

Figure 2C:
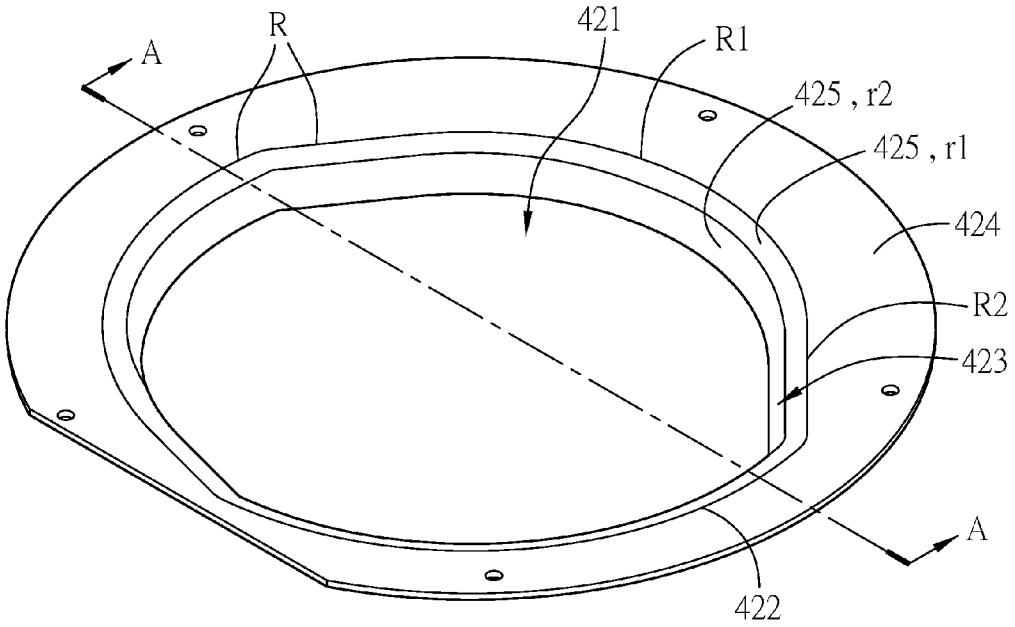
FIG. 2C is a schematic enlarged diagram of the inlet structure FIG. 2A.

FIG. 2C is a schematic enlarged diagram of the inlet structure in FIG. 2A. As shown in FIGS. 2C and 2A, the inlet structure 42 includes a top portion 422 and an edge portion 423. The top portion 422 is disposed around the opening 411 (as shown in FIG. 2B). The blades 311 are disposed near the edge portion 423 of the inlet structure 42. The inlet structure 42 further includes an extension portion 424, which extends from the top portion 422 to the side away from the edge portion 423. The extension portion 424 is fixed to the housing 41 by locking, engaging or adhering, for example, and thus the inlet structure 42 is fixed to the housing 41 (as shown in FIG.

The top portion 422 has a plurality of first chamfering angles R, and that means the top portion 422 is composed of a plurality of sections of first chamfering angles R. At least some of the first chamfering angles R are different, and several sections of these different chamfering angles form a noncircular hollow structure. Practically, the first chamfering angles can have different radiuses. As shown in FIG. 2C, the top portion 422 is composed of the first chamfering angles R1 and R2 which have different radiuses. The section of the first chamfering angle R can have a straight-line shape, just like the section of the first chamfering angle R2. In other embodiments, the bottom edge of the edge portion 423 also can be formed with a plurality of first chamfering angles R which are different from those of the top portion 422. However, the invention is not limited thereto.

Figure 2D:
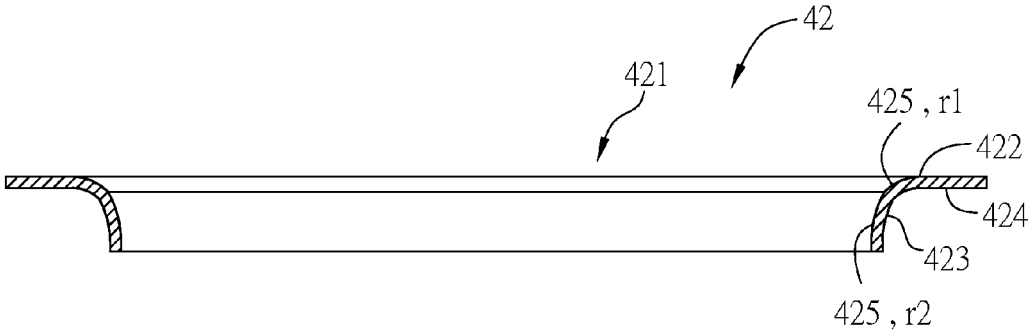
FIG. 2D is a schematic sectional diagram of the inlet structure taken along the line A-A in FIG. 2C FIGS. 2E and 2F are schematic diagrams of another embodiment of the inlet structure of FIG. 2A.

FIG. 2D is a schematic sectional diagram of the inlet structure taken along the line A-A in FIG. 2C. As shown in FIG. 2D, the edge portion 423 has a plurality of extension surfaces 425 extending from the top portion 422 to the accommodating space S (as shown in FIG. 2A) of the housing 41. The extension surfaces 425 can exert a flow guiding function to guide the outside air flowing into the accommodating space S for smoothing the airflow. Practically, an extension surface 425 extends from every section of the first chamfering angle R, and thus the entire edge portion 423 can have a plurality of extension surfaces 425 horizontally and vertically. Horizontally, the edge portion 423 has a plurality of extension surfaces 425 corresponding to different sections of the first chamfering angle R. Vertically, the extension surface 425 can include the second chamfering angle r2 or a slope C (as shown in FIG. 3B). Accordingly, the edge portion 423 includes the second chamfering angle r2, slope C or their combination. For example, the edge portion 423 of the first embodiment can be composed of a plurality of second chamfering angles r2, the edge portion 423 of the second and third embodiments can be composed of at least a second chamfering angles r2 and at least a slope C, and the edge portion 423 of the fourth embodiment can be composed of a plurality of slopes C. As shown in FIG. 2D, the end section of the edge portion 423, which is the furthest downstream location of the edge portion 423, is substantially aligned with the vertical direction parallel with a rotational axis of the centrifugal fan 3 (see FIG. 2B).

Figure 2E:
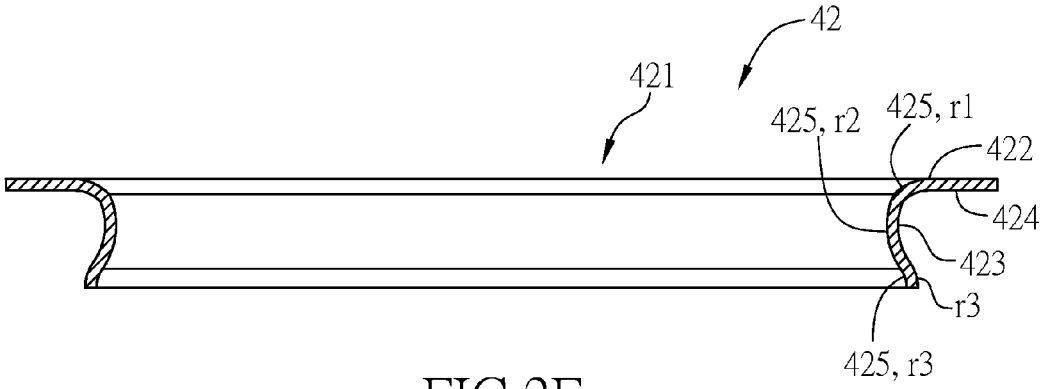
Figure 2F:
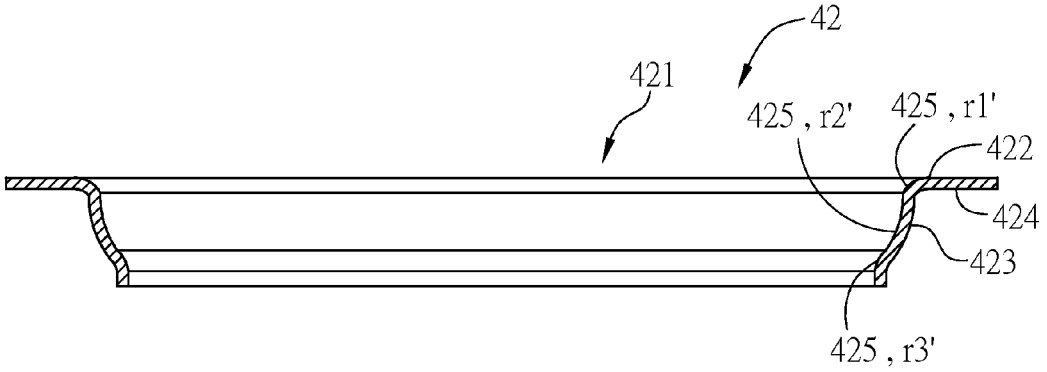

As shown in FIGS. 2C and 2D, in the first embodiment of the invention, the edge portion 423 is extended from the different first chamfering angles R, R1 and R2 and composed of two different second chamfering angles r1 and r2. In other embodiments, the edge portion can be composed of two similar second chamfering angles, but the invention is not limited thereto. FIGS. 2E and 2F are schematic diagrams of another embodiment of the inlet structure of FIG. 2A. As shown in FIGS. 2E and 2F, the second chamfering angles r1 and r2 have different radiuses, and besides the second chamfering angles r1, r2 and r3 can have different extending directions. In the invention, the extension surface 425 is defined as a positive direction if extending toward the hollow portion 421, such as the second chamfering angles r1 and r2 in FIG. 2E. The extension surface 425 is defined as a negative direction if extending toward the outside of the hollow portion 421, such as the second chamfering angle r3 in FIG. 2E. The edge portion 423 can be composed of the extension surfaces 425 of the positive and/or negative direction. In FIG. 2F, the edge portion 425 is composed of the positive-direction extension surfaces of the second chamfering angles r1' and r3' and the negative-direction extension surface 425 of the second chamfering angle r2'.

In FIG. 2C, in a horizontal view, the extension surfaces 425 connecting to the top portion 422 are all of the second chamfering angle r1, but however, in other embodiments, they can be arranged into alternate second chamfering angles r1 and r2, or other chamfering angles of different radians. In other words, the extension surfaces 425 connecting to the top portion 422 can have different chamfering angles (referring to FIG. 4).

In general, the fan frame is designed with a square or corner structure, which easily results in an uneven flow field. In the first embodiment of the invention, the top portion 422 is formed with a plurality of first chamfering angles R and the edge portion 423 is formed with a plurality second chamfering angles r1 and r2, and thereby the more airflow can be more smoothly guided into the accommodating space S. Therefore, the flow field can be efficiently improved and become smoother.

Figure 3A:
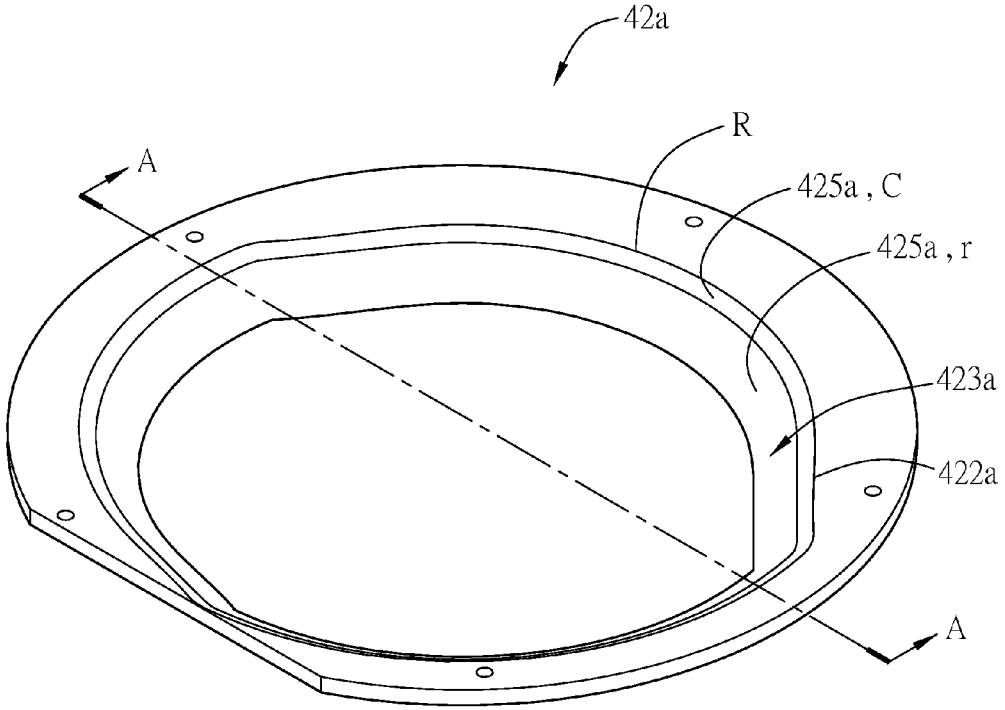
FIG. 3A is a schematic diagram of the inlet structure of the second embodiment of the invention.
Figure 3B:
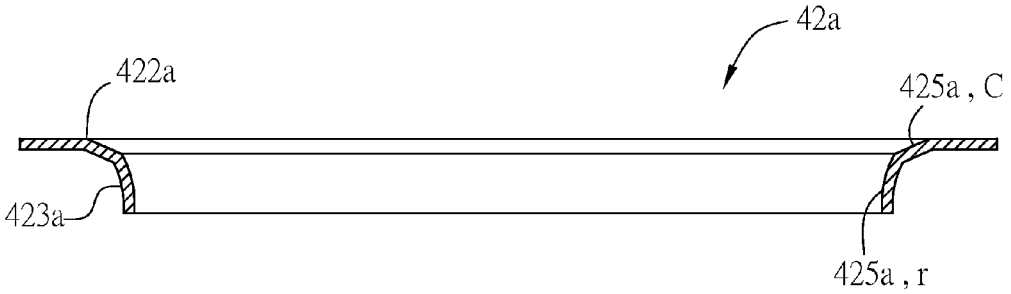
FIG. 3B is a schematic sectional diagram of the inlet structure taken along the line A-A in FIG. 3A.

FIG. 3A is a schematic diagram of the inlet structure of the second embodiment of the invention, and FIG. 3B is a schematic sectional diagram of the inlet structure taken along the line A-A in FIG. 3A. As shown in FIGS. 3A, 3B and 2A, for the inlet structure 42*a*, a plurality of extension surfaces 425*a* are extended from the sections of the first chamfering angle R, respectively. Different from the first embodiment, the extension surface 425*a* of the edge portion 423*a* of this embodiment includes at least a second chamfering angle r and at least a slope C. Other technical features of the inlet structure 42*a* and housing 41 of this embodiment can be comprehended by referring to the first embodiment, and therefore they are not described here for conciseness.

Figure 4:
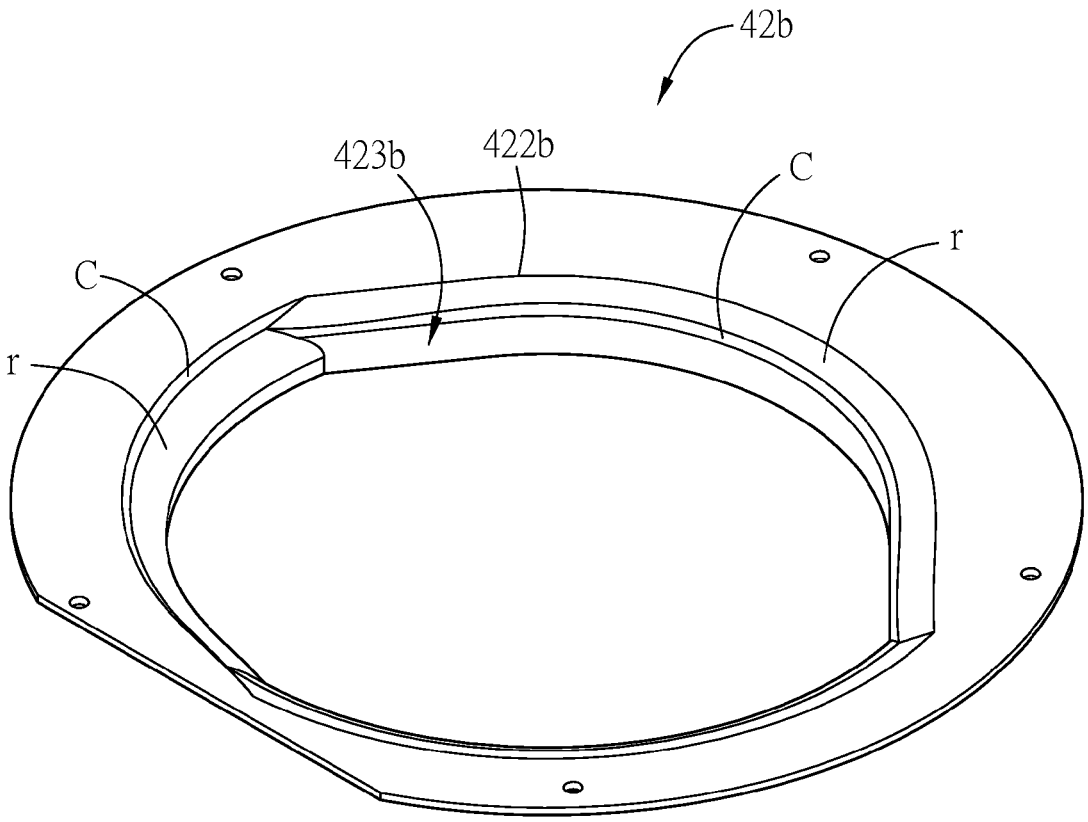
FIG. 4 is a schematic diagram of the inlet structure of the third embodiment of the invention.

Like the second chamfering angle r, the slope C also can make the airflow more smoothly. The disposition and number of the second chamfering angle r and slope C can be determined according to the flow path of the outside airflow guided into the accommodating space S and the direction of the generated flow field. FIG. 4 is a schematic diagram of the inlet structure of the third embodiment of the invention. Concerning the above factors, the edge portion 423*b* of the inlet structure 42*b* in FIG. 4 is formed with a plurality of second chamfering angles r having different radians and a plurality of slopes C having different slope degrees. Whether in a horizontal or vertical view, the edge portion is composed of at least a second chamfering angle r and at least a slope C. Horizontally, the part of the edge portion 423*b* adjacent to the top portion 422*b* is composed of a plurality of second chamfering angles r and a plurality of slopes C. Vertically, the edge portion 423*b* is composed of two slopes C and a second chamfering angle r that is between the two slopes C.

Figure 5A:
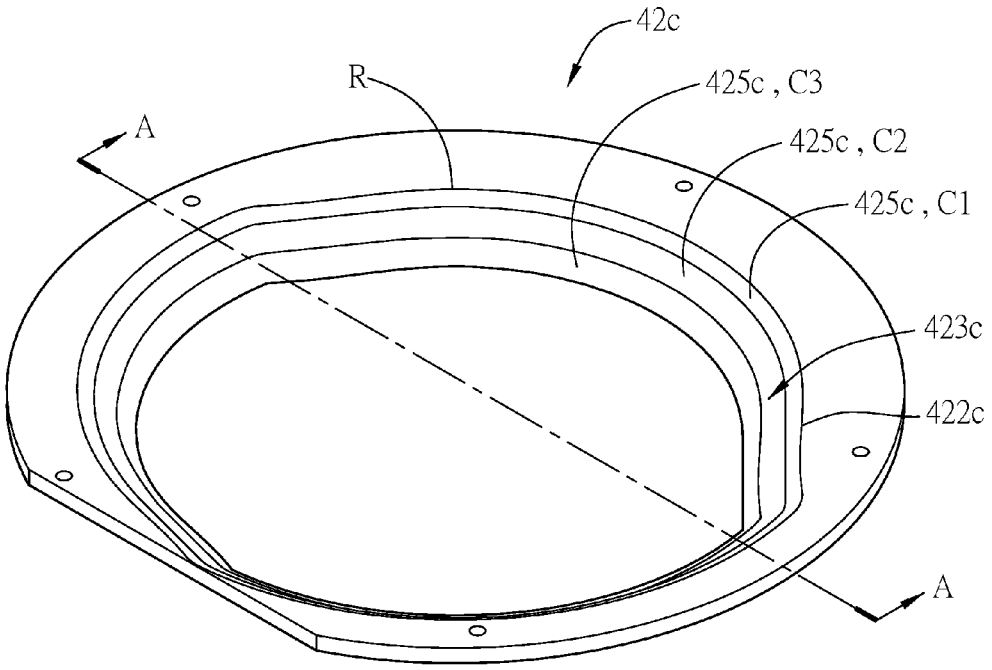
FIG. 5A is a schematic diagram of the inlet structure of the fourth embodiment of the invention.
Figure 5B:
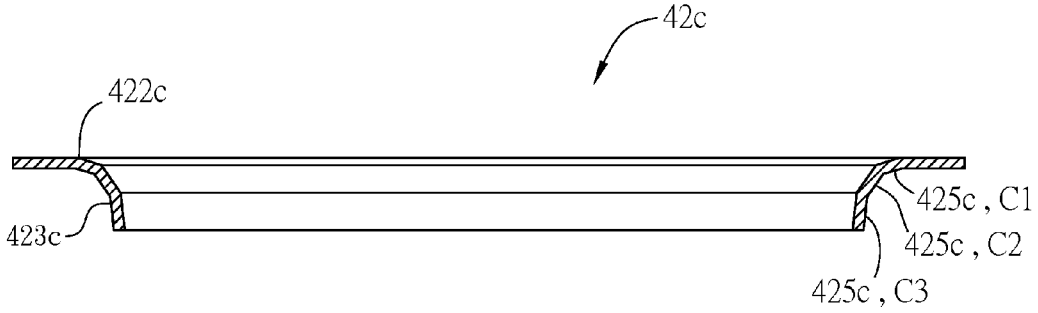
FIG. 5B is a schematic sectional diagram of the inlet structure taken along the line A-A in FIG. 5A.

FIG. 5A is a schematic diagram of the inlet structure of the fourth embodiment of the invention, and FIG. 5B is a schematic sectional diagram of the inlet structure taken along the line A-A in FIG. 5A. As shown in FIGS. 5A, 5B and 2C, different from the first embodiment, the extension surfaces 425*c* of the edge portion 423*c* include a plurality of slopes C1, C2 and C3. Other technical features of the inlet structure 42*c* and housing 41 of this embodiment can be comprehended by referring to the first embodiment, and therefore they are not described here for conciseness.

Accordingly, concerning the path of the airflow and the direction of the flow field, the edge portion 423*c* extending from the top portion 422*c* to the inside (FIG. 2A) of the housing 41 is firmed with the slopes C1, C2 and C3, and at least two of the slopes C1, C2 and C3 are different. In this embodiment, the slopes C1, C2 and C3 are different from one another. Likewise, the design of the slopes C1, C2 and C3 can cause more airflow guided into the accommodating space S and make the flow field smoother.

Figure 6A:
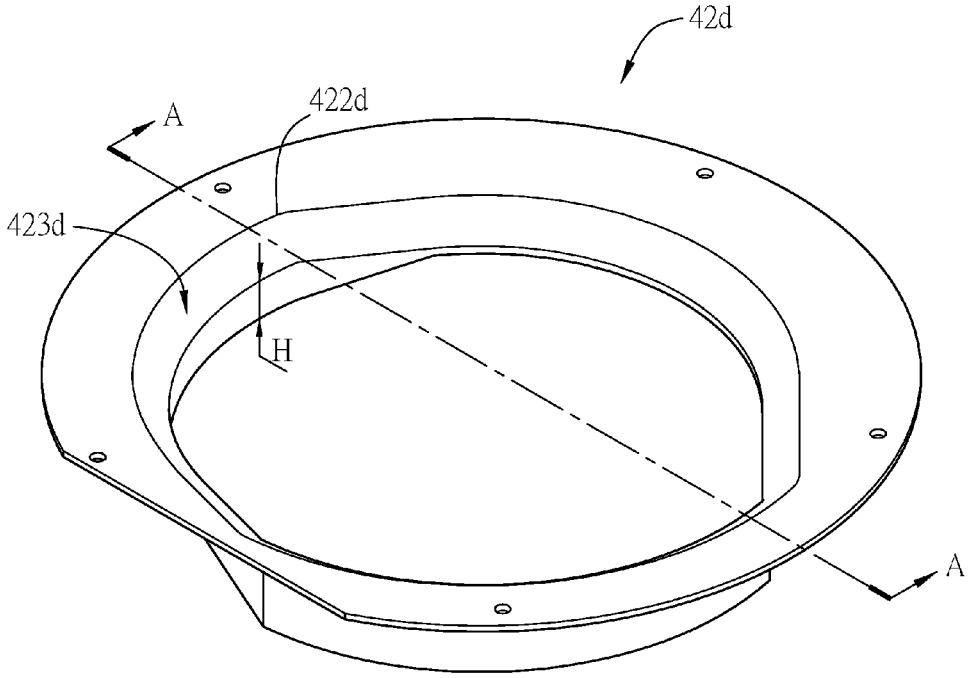
FIG. 6A is a schematic diagram of the inlet structure of the fifth embodiment of the invention.
Figure 6B:
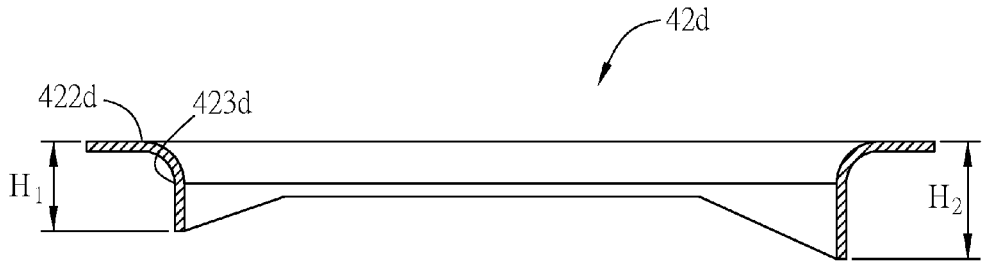
FIG. 6B is a schematic sectional diagram of the inlet structure taken along the line A-A in FIG. 6A.

FIG. 6A is a schematic diagram of the inlet structure of the fifth embodiment of the invention, and FIG. 6B is a schematic sectional diagram of the inlet structure taken along the line A-A in FIG. 6A. The length of the edge portion also can be adjusted according to the form of the flow field. As shown in FIGS. 6A and 6B, the edge portion 423*d* of the inlet structure 42*d* is extended from the top portion 422*d* for a length H. The edge portion 423*d* with a greater length H is able to avoid the air leakage. Thus, different parts of the edge portion 423*d* can have their respective heights determined according to the form of the flow field. Therefore, the edge portion 423*d* may have a plurality of different lengths, and for example the lengths are irregular. In this embodiment, the edge portion 423*d* has different lengths at the opposite sides. As shown in FIG. 6B, the edge portion 423*d* has a length H1 on one side of the line A-A, and has a length H2 one the other side of the line A-A. The lengths H1 and H2 are different from each other. To be noted, the length design of the edge portion can be applied to the first to fourth embodiments.

Figure 7A:
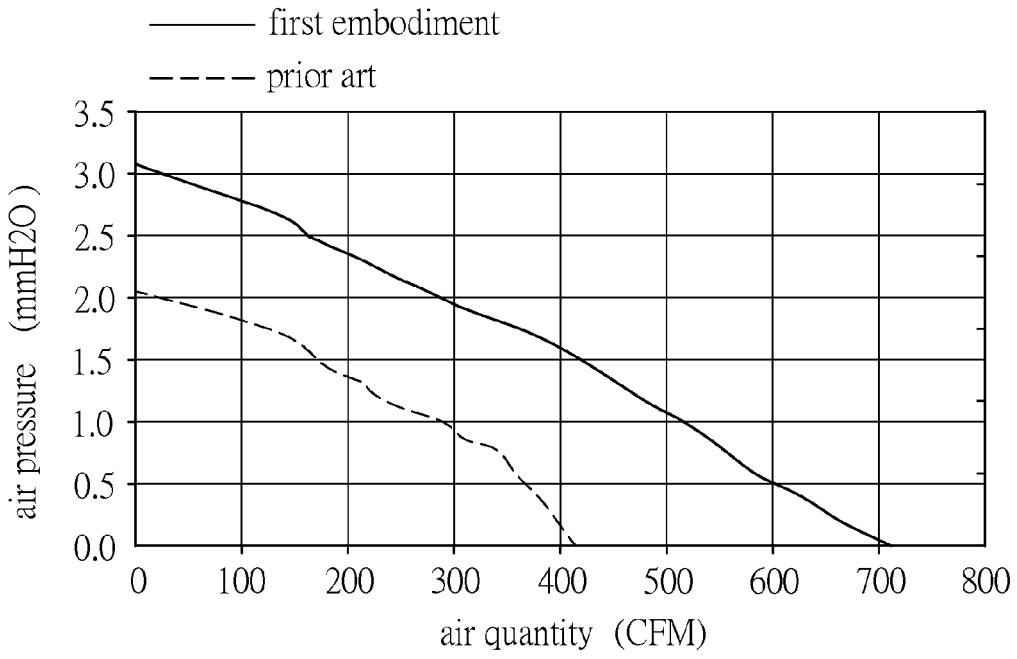
FIG. 7A is a schematic diagram of the air pressure comparison between the centrifugal fan of the first embodiment of the invention and the centrifugal fan of the prior art.
Figure 7B:
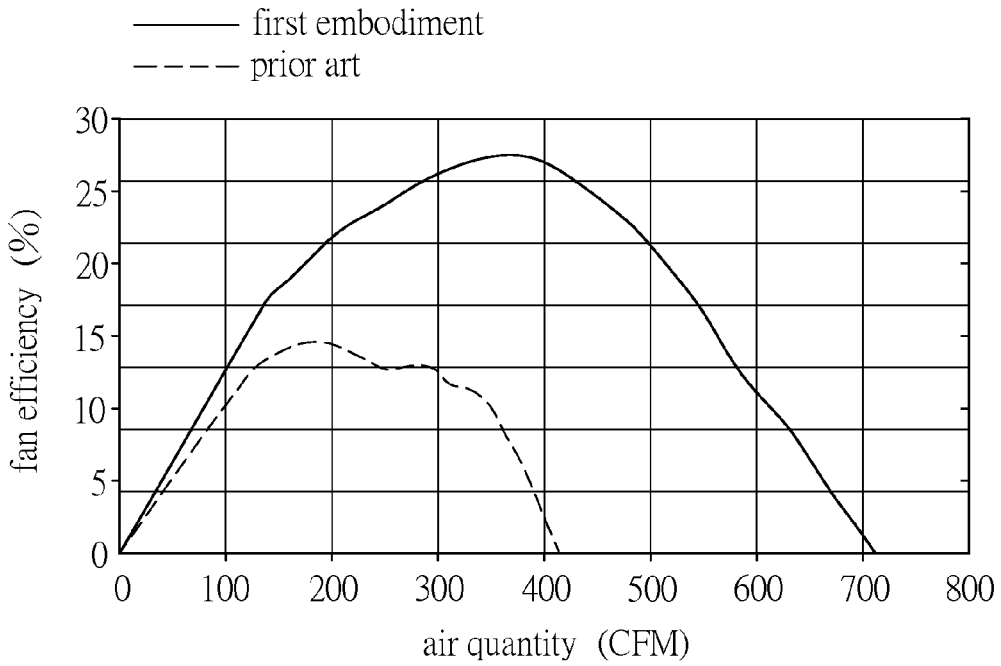
FIG. 7B is a schematic diagram of the fan efficiency comparison between the centrifugal fan of the first embodiment of the invention and the conventional centrifugal fan.

FIG. 7A is a schematic diagram of the air pressure comparison between the centrifugal fan of the first embodiment of the invention in FIGS. 2C and 2D and the centrifugal fan of the prior art. From FIG. 7A, it can be seen that the air pressure of the fan of the first embodiment is higher than that of the conventional fan by 2 $mmH_2O$ at the same air quantity such as 200 CFM (cubic feet per minute). FIG. 7B is a schematic diagram of the fan efficiency comparison between the centrifugal fan of the first embodiment of the invention and the conventional centrifugal fan. It can be seen from FIG. 7B that the fan efficiency of the fan of the first embodiment is obviously higher than the conventional fan. Therefore, for the fan using the inlet structure according to the invention, the air pressure and fan efficiency truly can be enhanced.

Besides, a centrifugal fan is also disclosed in the invention. The technical features of the centrifugal fan can be comprehended by referring to the foregoing embodiments, and therefore they are not described here for conciseness.

In summary, the shape of the inlet structure of the centrifugal fan of the invention is changed and thus the form of the inlet of the fan is changed accordingly. Thereby, the air quantity entering to the fan is increased and the fan efficiency is enhanced. In detail, the inlet structure is formed with a plurality of first chamfering angles, at least one of the first chamfering angles is different from the others, so the hollow portion of the inlet structure is changed into a non-circular shape to adjust the airflow. Besides, the edge portion has a plurality of extension surfaces extending from the top portion to the inside of the housing, and the extension surfaces can be designed according to many factors, such as the whole structure of the housing, airflow path and desired flow field, and thus include at least one second chamfering angle and at least one slope. Thereby, the outside air can be more smoothly guided into the fan. Therefore, the air quantity and fan efficiency are increased and the flow field is smoothed effectively.

Furthermore, the length of the edge portion can be adjusted according to the form of the flow field. For example, when the part of the edge portion probably leaks air, it can be formed with a greater length in order to eliminate the air leakage.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan frame of a centrifugal fan, comprising:

a housing including an opening; and an inlet structure disposed at the opening, wherein the inlet structure is a noncircular structure and has a hollow portion corresponding to the opening, the inlet structure and the opening cooperatively form an inlet of the centrifugal fan, and the inlet structure includes:

a top portion disposed around the opening and including a plurality of first chamfering angles around the opening, at least one of the first chamfering angles around the opening having a different radius along a horizontal direction from the others around the opening; and an edge portion extending from the top portion to the inside of the housing through the opening and including a plurality of arc sections having second chamfering angles all around the opening, at least one of the second chamfering angles having a different radius along a vertical direction from the others, wherein the edge portion has an end section that is substantially aligned with the vertical direction parallel with a rotational axis of the centrifugal fan.

2. The fan frame as recited in claim 1, wherein at least some of the arc sections are different.

3. The fan frame as recited in claim 1, wherein the length of the edge portion is uneven.

4. The fan frame as recited in claim 3, wherein the edge portion has different lengths at the opposite sides thereof.

5. The fan frame as recited in claim 1, wherein the inlet structure further includes an extension portion, which is extended from the top portion to the side away from the edge portion and fixed to the housing.

6. The fan frame as recited in claim 1, wherein the edge portion further includes a plurality of slopes, and at least some of the slopes are different.

7. A fan frame of a centrifugal fan, comprising:

a housing including an opening; and an inlet structure disposed at the opening, wherein the inlet structure is a noncircular structure and has a hollow portion corresponding to the opening, the inlet structure and the opening cooperatively form an inlet of the centrifugal fan, and the inlet structure includes:

a top portion disposed around the opening and including a plurality of first chamfering angles around the opening, at least one of the first chamfering angles around the opening having a different radius along a horizontal direction from the others around the opening, and several sections of these different first chamfering angles form a noncircular hollow structure; and an edge portion extending from the top portion to the inside of the housing through the opening and including at least an arc section having second chamfering angles all around the opening, at least one of the second chamfering angles having a different radius along a vertical direction from the others and at least a slope, wherein the edge portion has an end section that is substantially aligned with the vertical direction parallel with a rotational axis of the centrifugal fan.

8. The fan frame as recited in claim 7, wherein when the edge portion includes a plurality of arc sections, at least some of the arc sections are different.

9. The fan frame as recited in claim 7, wherein the length of the edge portion is uneven.

10. The fan frame as recited in claim 9, wherein the edge portion has different lengths at the opposite sides thereof.

11. The fan frame as recited in claim 7, wherein the inlet structure further includes an extension portion, which is extended from the top portion to the side away from the edge portion and fixed to the housing.

12. The fan frame as recited in claim 7, wherein when the edge portion includes a plurality of slopes, at least some of the slopes are different.

13. A fan frame of a centrifugal fan, comprising:

a housing including an opening; and an inlet structure disposed at the opening, wherein the inlet structure is a noncircular structure and has a hollow portion corresponding to the opening, the inlet structure and the opening cooperatively form an inlet of the centrifugal fan, and the inlet structure includes:

a top portion disposed around the opening and including a plurality of first chamfering angles around the opening, at least one of the first chamfering angles around the opening having a different radius along a horizontal direction from the others around the opening, and several sections of these different first chamfering angles around the opening form a noncircular hollow structure; and an edge portion extending from the top portion to the inside of the housing through the opening and including a plurality of extension surfaces, wherein the extension surfaces include arc sections having second chamfering angles all around the opening, at least one of the second chamfering angles having a different radius along a vertical direction from the others, wherein the edge portion has an end section that is substantially aligned with the vertical direction parallel with a rotational axis of the centrifugal fan.

14. The fan frame as recited in claim 13, wherein each of the extension surfaces further includes a slope.

15. The fan frame as recited in claim 13, wherein at least some of the arc sections are different.

16. The fan frame as recited in claim 14, wherein at least some of the slopes are different.

17. The fan frame as recited in claim 13, wherein the length of the edge portion is uneven.

18. The fan frame as recited in claim 17, wherein the edge portion has different lengths at the opposite sides thereof.

19. The fan frame as recited in claim 13, wherein the inlet structure further includes an extension portion, which is extended from the top portion to the side away from the edge portion and fixed to the housing.

* * * * *